US009357845B1

(12) United States Patent
Jenkinson

(10) Patent No.: US 9,357,845 B1
(45) Date of Patent: Jun. 7, 2016

(54) SHELF ASSEMBLY

(71) Applicant: Electrolux Home Products, Inc., Charlotte, NC (US)

(72) Inventor: Peter Jenkinson, Anderson, SC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 0 days.

(21) Appl. No.: 14/577,460

(22) Filed: Dec. 19, 2014

(51) Int. Cl.
*A47B 96/06* (2006.01)
*F25D 25/02* (2006.01)
*A47B 96/02* (2006.01)

(52) U.S. Cl.
CPC ..... *A47B 96/068* (2013.01); *A47B 96/021* (2013.01); *F25D 25/02* (2013.01)

(58) Field of Classification Search
CPC ..... A47B 57/00; A47B 57/04; A47B 91/00; A47B 96/02; A47B 96/068; A47B 96/021; A47F 5/103; A47F 1/12; A47F 3/04; A47F 3/0486; F25D 25/02
USPC ..... 211/186, 187
See application file for complete search history.

(56) References Cited

U.S. PATENT DOCUMENTS 3,120,199 A * 2/1964 Kolster et al. ..... 108/6
4,461,388 A * 7/1984 Bustos ..... 211/59.2
5,362,145 A 11/1994 Bird et al.
5,429,433 A 7/1995 Bird et al.
5,577,623 A * 11/1996 Bustos ..... 211/187
5,641,217 A 6/1997 Caruso et al.
5,697,302 A * 12/1997 Putnam ..... 108/90
6,422,673 B1 7/2002 Bienick
6,488,347 B1 12/2002 Bienick
6,679,573 B2 1/2004 Bienick
6,725,785 B2 * 4/2004 Wang ..... 108/90
7,147,293 B2 12/2006 Bienick et al.
7,237,856 B2 7/2007 Bienick et al.
7,562,630 B2 7/2009 Lee et al.
7,748,804 B2 7/2010 Lim et al.
8,287,062 B2 10/2012 Nash et al.
8,403,437 B2 3/2013 Bergmann et al.
8,480,194 B2 7/2013 Leconte et al.
8,534,783 B2 9/2013 Nash et al.
2004/0195945 A1 10/2004 Farber et al.
2006/0097613 A1 5/2006 Lee et al.
2007/0075199 A1 4/2007 Stewart et al.
2010/0181884 A1 7/2010 De La Garza et al.
2011/0115356 A1 5/2011 Nash et al.

* cited by examiner

*Primary Examiner* — Korie H Chan
(74) *Attorney, Agent, or Firm* — Pearne & Gordon LLP

(57) ABSTRACT

A shelf assembly includes a shelf frame adapted to support a planar shelf panel. The shelf frame comprises a front member, opposed side members, and a rear member. A support channel is integrally formed into an underside of the shelf frame. A reinforcing support frame is captured within the support channel to form a unitary shelf assembly and is adapted to support the shelf frame within said appliance. At least one stud projects outward from the reinforcing support frame with respect to the opposed side members of the shelf frame. The studs are adapted to be received within a corresponding recess of an interior wall of said appliance to thereby support the shelf assembly within said appliance.

20 Claims, 8 Drawing Sheets

SHELF ASSEMBLY

CROSS-REFERENCE TO RELATED APPLICATIONS

Not applicable.

FIELD OF THE INVENTION

The present application relates generally to a shelf assembly, and more particularly, to a shelf assembly for an appliance.

BACKGROUND OF THE INVENTION

Appliances, such as refrigerators, are known to include a plurality of shelves for storing various items. Conventional shelves are beneficial to accommodate stored items such as large pizza boxes, wine bottles and/or other food or beverage containers.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect, a shelf assembly for an appliance comprises a shelf panel comprising a generally planar support surface. A shelf frame is adapted to be mounted within an appliance to support the shelf panel with the support surface extending generally along a horizontal plane, the shelf frame comprising a front member, opposed side members, and a rear member that together define an outer periphery. A support channel is formed into an underside of the outer periphery of the shelf frame along each of the front member, opposed side members, and the rear member so that the support channel is substantially co-extensive with the outer periphery. A reinforcing support frame is adapted to support the shelf frame within said appliance. The reinforcing support frame comprises a front support member, opposed side support members, and a rear support member. The reinforcing support frame is co-extensive with the support channel of the shelf frame and is captured within the support channel to form a unitary shelf assembly. At least one stud projects outward from each of the opposed side support members of the reinforcing support frame. The studs are adapted to be received within a corresponding recess of an interior wall of said appliance to thereby support the shelf assembly within said appliance.

In accordance with another aspect, a shelf assembly for an appliance comprises a shelf panel comprising a generally planar support surface. A shelf frame is adapted to support the shelf panel with the support surface extending generally along a horizontal plane, the shelf frame comprising a front member, opposed side members, and a rear member that together define an outer periphery. A support channel is integrally formed as a monolithic element with the shelf frame into an underside of the shelf frame along each of the front member and the rear member so that the support channel is substantially co-extensive with the front and rear members. A reinforcing support frame is adapted to support the shelf frame within said appliance. The reinforcing support frame comprises a front support member and a rear support member. The reinforcing support frame is co-extensive with the support channel of the shelf frame along the front and rear members and is captured within the support channel to form a unitary shelf assembly. At least one stud projects outward from the reinforcing support frame with respect to the opposed side members of the shelf frame. The studs are adapted to be received within a corresponding recess of an interior wall of said appliance to thereby support the shelf assembly within said appliance.

It is to be understood that both the foregoing general description and the following detailed description present example and explanatory embodiments of the invention, and are intended to provide an overview or framework for understanding the nature and character of the invention as it is claimed. The accompanying drawings are included to provide a further understanding of the invention and are incorporated into and constitute a part of this specification. The drawings illustrate various example embodiments of the invention, and together with the description, serve to explain the principles and operations of the invention.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
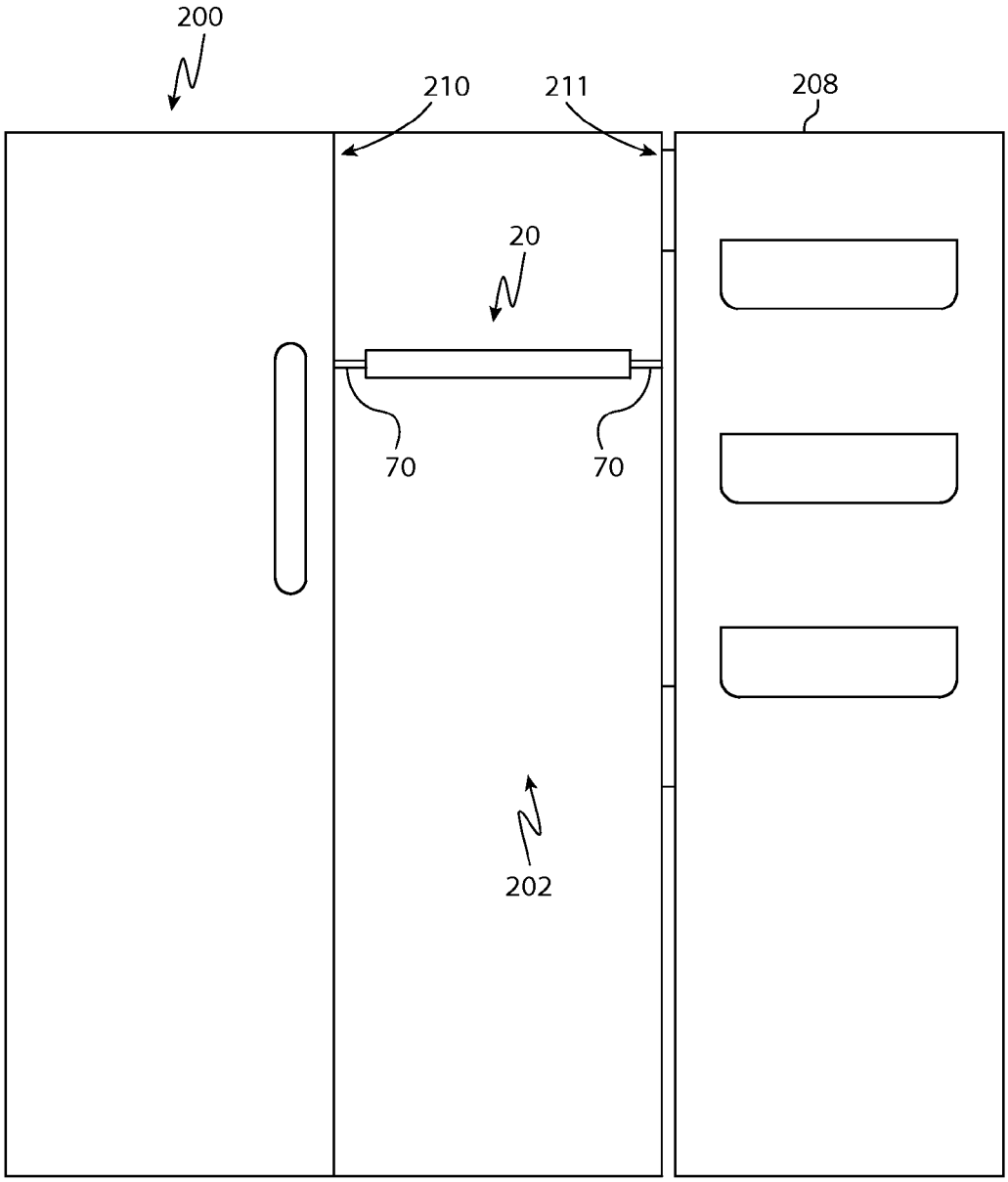
FIG. 1 is a schematic view of a refrigerator including an example shelf assembly.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Conventional glass shelves for refrigerators typically include a plastic frame that is either over-molded/encapsulated onto the glass panel, or adhered to the glass panel using a non-removable adhesive. Both of these increase cost and complexity.

Moreover, while plastic materials can provide many benefits to shelving, it is beneficial to increase the loading capacity of a shelf by adding a reinforcement structure. It is further beneficial to have a shelf that provides the benefits and aesthetic appearance of a glass and plastic shelf, while replacing the conventional utility of a wire-frame shelf that attaches directly to the interior walls of the refrigerator liner. The shelf frame is preferably manufactured of an injection-molded plastic that is generally rigid, although additional strength is provided by a hidden strengthening frame.

Turning to the shown example of FIG. 1, a shelf assembly 20 is described that can be used in different types of appliances, such as refrigeration appliances, freezers, dishwashers, ovens, or even other appliance types. For instance, the shelf assembly 20 can be used in storage systems for refrigeration appliances such as refrigerator/freezer units, standalone refrigerators, standalone freezers, or the like. Although the example refrigerator is illustrated as a side-by-side type refrigerator, the instant shelf assembly 20 could similarly be used in a top-mount refrigerator, bottom-mount refrigerator, French-door refrigerator, or even other types of refrigerators or freezers. In addition to white goods (e.g., appliances), the structure and assembly method herein can be used to create a planer or vertical surface with furniture, storage applications and architectural applications. Moreover, it is contemplated that instead of being a shelf assembly to support goods, the structure of the instant application could instead be used to provide a vertical, angled, or horizontal divider that can separate adjacent areas. FIG. 1 depicts a schematic view of a refrigerator 200 including a schematic depiction of a shelf assembly 20 in accordance with aspects of the present application. In one example, the refrigerator 200 can include a cabinet with an interior liner having at a pair of opposing interior side walls 210, 211 defining an interior area 202. A refrigerator door 208 can be opened to provide access to one or more shelf assemblies 20.

Moreover, it is contemplated that the shelf assembly 20 can include support structure, as will be described herein, configured to be attached with respect to the side walls 210, 211 of the cabinet 209 to support the shelf within the interior area 202 of the cabinet. It is contemplated that the shelf assembly 20 can be vertically adjusted to a desired elevation within the interior area 202 of the cabinet 209. Various types of interlocking devices can be used, such as a stud projection from the shelf assembly 20 that can lockingly engage corresponding recess structure on the side walls 210, 211. In any event, it is preferred that the shelf assembly 20 is removable from the interior area 202 of the appliance for cleaning, replacement, etc. Although the Figures illustrate the walls 210, 211 as lateral side walls, it is understood that the shelf assembly 20 could be coupled to structure on a rear wall of the cabinet.

Figure 2:
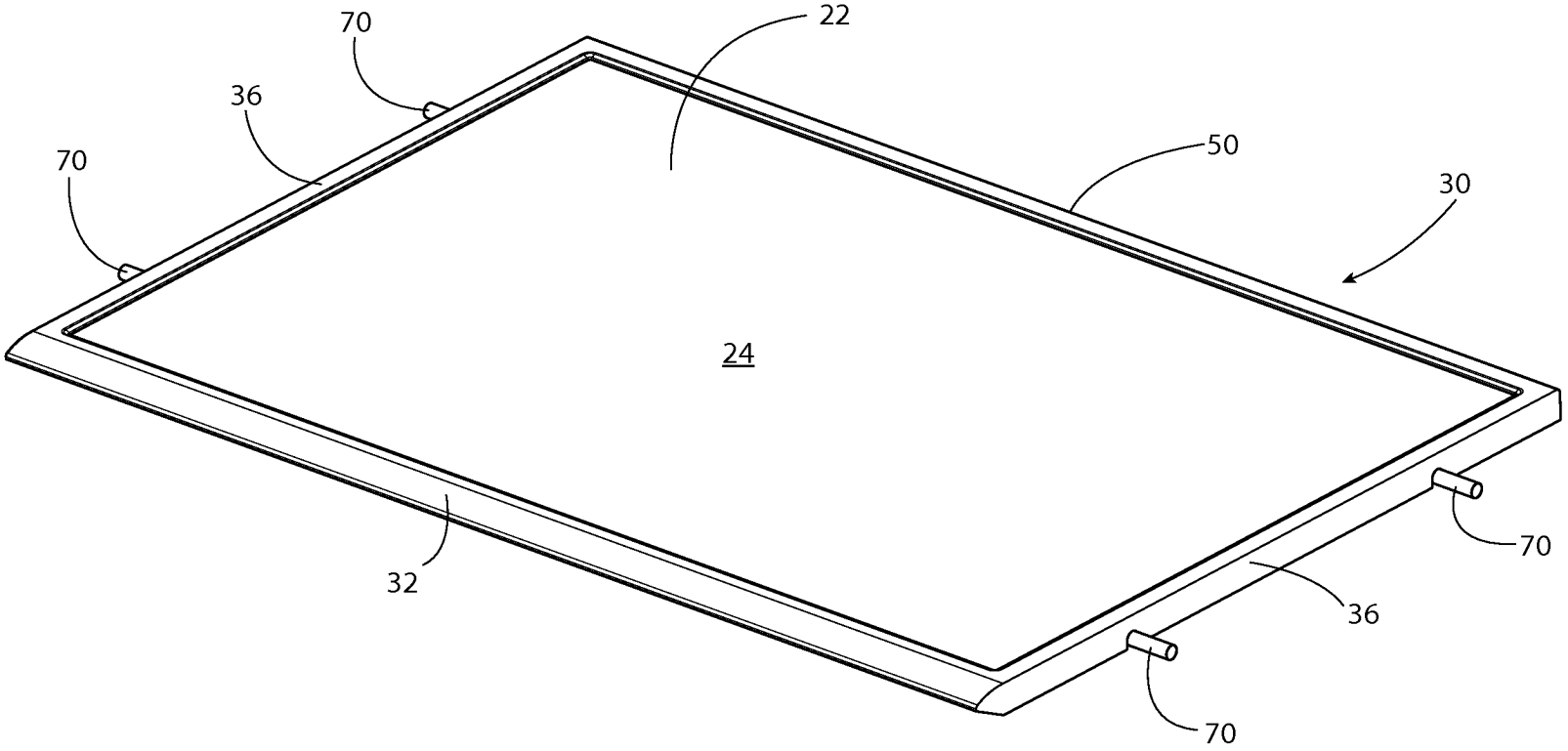
FIG. 2 is a perspective view of an example shelf assembly.
Figure 3A:
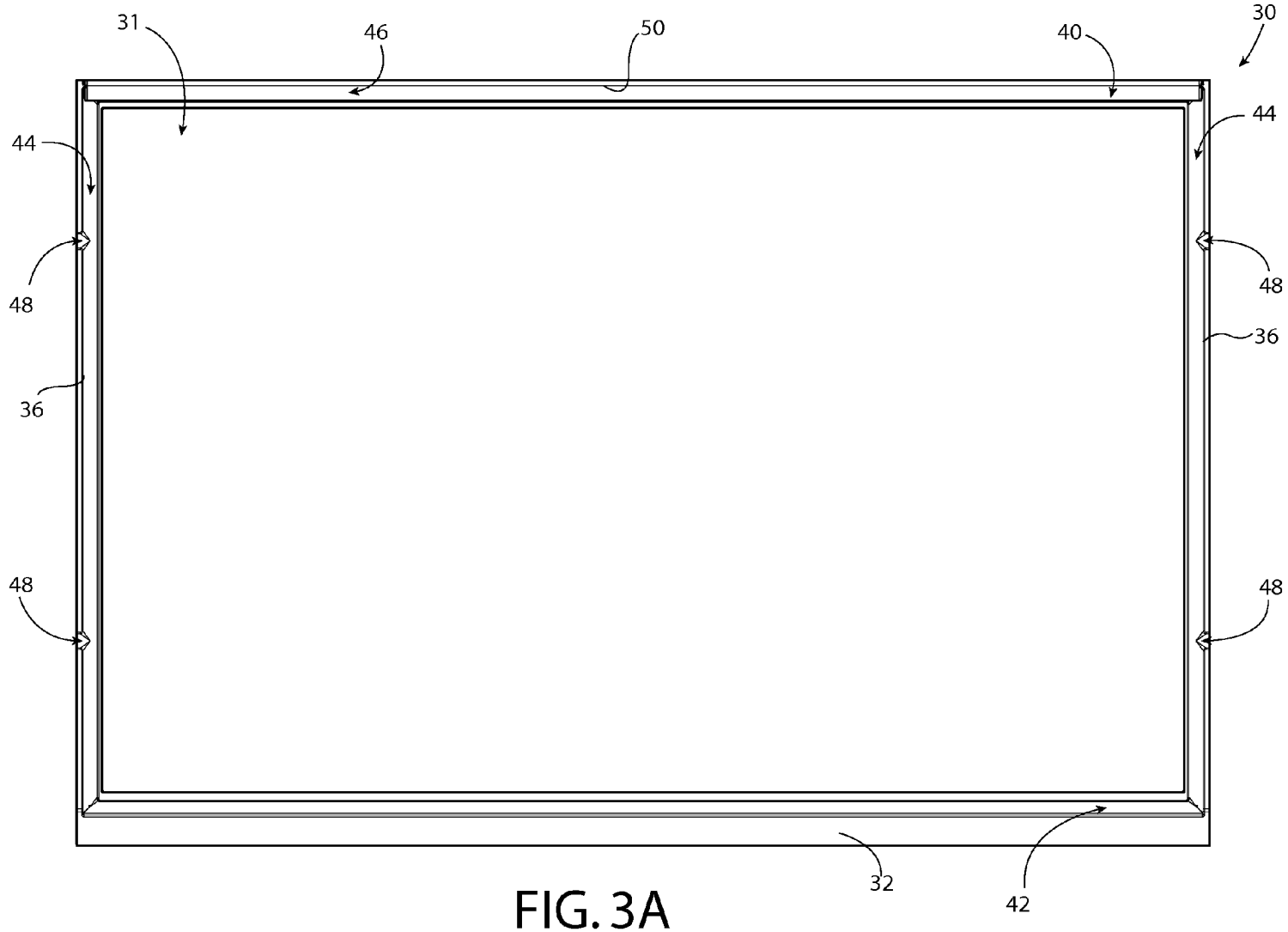
FIG. 3A is a bottom view of an example shelf frame.
Figure 3B:
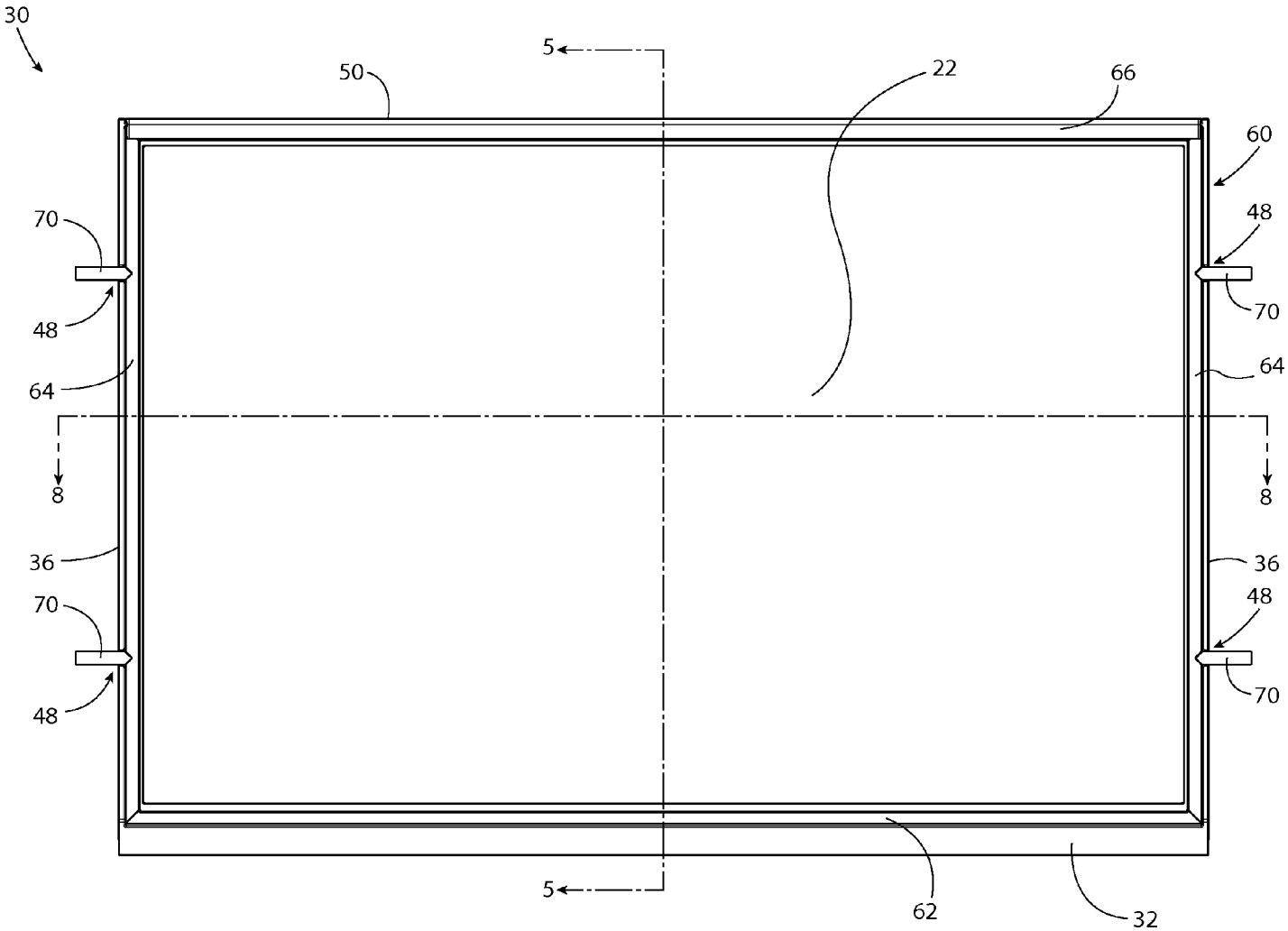
FIG. 3B is a bottom view of the shelf frame that is assembled with an example reinforcing support frame.

Turning now to FIGS. 2-3B, the shelf assembly 20 includes a shelf panel 22 with a generally planar support surface 24 that is supported by a frame 30. The generally planar support surface 24 is defined by a front edge 26, opposed side edges 27, and a rear edge 28 that together define an outer periphery. The outer periphery generally bounds a central opening 31 that extends through the shelf frame 30, and which is covered by the shelf panel 22. The shelf panel 22 can have various shapes and dimensions with the generally planar support surface 24 configured to support various objects for storage within an interior of the appliance. The shelf panel 22 can have a generally square or rectangular geometry, although other shapes are contemplated. In other examples, the shelf panel 22 can be formed of various generally rigid materials, such as glass, plastic, metal, wire, or other suitable material. Preferably, the shelf panel 22 comprises a generally translucent or transparent material, such as a tempered or toughened glass or polymer panel suitable for use in a refrigerator environment. Additionally, the shelf panel 22 may have a generally constant thickness therethrough.

The shelf assembly 20 further includes the frame 30 configured to be mounted to the interior of the refrigerator 200 to support the shelf panel 22 with the support surface 24 extending generally along a horizontal plane. Of course, the frame 30 could also be configured to support the shelf panel 22 in various other orientations. The frame 30 includes a front member 32, opposed side members 36, and a rear member 50. Each of the elongated front member 32 and rear member 50 extend laterally between the pair of side members 36 and are configured to support the shelf panel 22 along the horizontal plane. The frame 30 may further include any or all of a front support and side supports that together can support the shelf panel around three of its sides.

The frame 30 can be formed of a generally rigid material, such as metal, plastic, or the like. In one example, the frame 30 can be formed of an injection molded plastic, and may be formed as a monolithic unit. For example, the front member 32, side members 36, and rear member 50 can be integrally formed as a monolithic body to define the frame 30. Still, the frame 30 can be assembled from various elements. For example, some or all of the front, side, and rear members can be removably or non-removably attached to each other to define the frame 30. Additionally, the frame 30 may include additional features, such as raised or angled edges extending along the outer perimeter (e.g., front, rear, and/or side edges) to retain spills on the support surface 24 to provide a "spill proof" shelf. For example, some or all of the front member 32, opposed side members 36, and rear member 50 of the frame 30 can define an upper peripheral rim 39 which is raised a distance above the shelf panel 22. The "spill proof" application can be enhanced by application of a food grade compound (silicon or similar) for white goods or general sealant for other applications between the shelf frame and the glass panel. Finally, as will be discussed herein, in one embodiment at least part of the rear member of the frame can be designed to be elastically deformable.

Turning specifically to FIG. 3A, the shelf frame 30 further includes a support channel 40 formed into an underside of the shelf frame 30. The support channel 40 extends along each of the front member 32 and the rear member 50 of the shelf frame 30 so that the support channel 40 is substantially co-extensive with the front and rear members 32, 50. Preferably, the support channel 40 extends along each of the front member 32, opposed side members 36, and rear member 50 so that the support channel 40 is preferably substantially co-extensive with the outer periphery of the shelf frame 30. Preferably, the support channel 40 is integrally formed into the outer periphery as a monolithic element with the shelf frame 30. Some or all of the support channel 40 is further formed as a recess open to the exterior environment that extends a distance inwards into the underside of the outer periphery of the shelf frame 30. The support channel 40 can have various geometries, as will be discussed herein.

The support channel 40 can extend variously along each of the front member 32, opposed side members 36, and rear member 50, such as along substantially the entire length of each of the edges of the frame 30. The support channel 40 may be a continuous channel that runs around the outer periphery of the frame 30, or be a combination of separate interconnected channels that form an effectively continuous support channel 40, or even be a combination of separate interconnected channels that are discontinuous. In the shown example, the support channel 40 can include a front portion 42 that extends along the front member 32, side portions 44 that extend along the side members 36, and a rear portion 46 that extends along the rear member 50. Preferably, each of the front portion 42, side portions 44, and rear portion 46 are contiguous along each associated edge of the frame 30. Still, it is contemplated that the various portions of the support channel 40 may each be discontinuous and/or extend along less than the entire edges of the shelf panel 30, such as about 90% or less, about 80% or less, about 70% or less, about 60% or less, about 50% or less, about 40% or less, about 30% or less, or even about 20% or less. Additionally, the frame 30 can further include one or more side apertures 48 that extend from the support channel 40, and outwards therethrough to an exterior of the shelf frame 30. Preferably, the side apertures 48 are located on the side members 36 and are in direct communication with the side portions 44 of the support channel 40.

Figure 4:
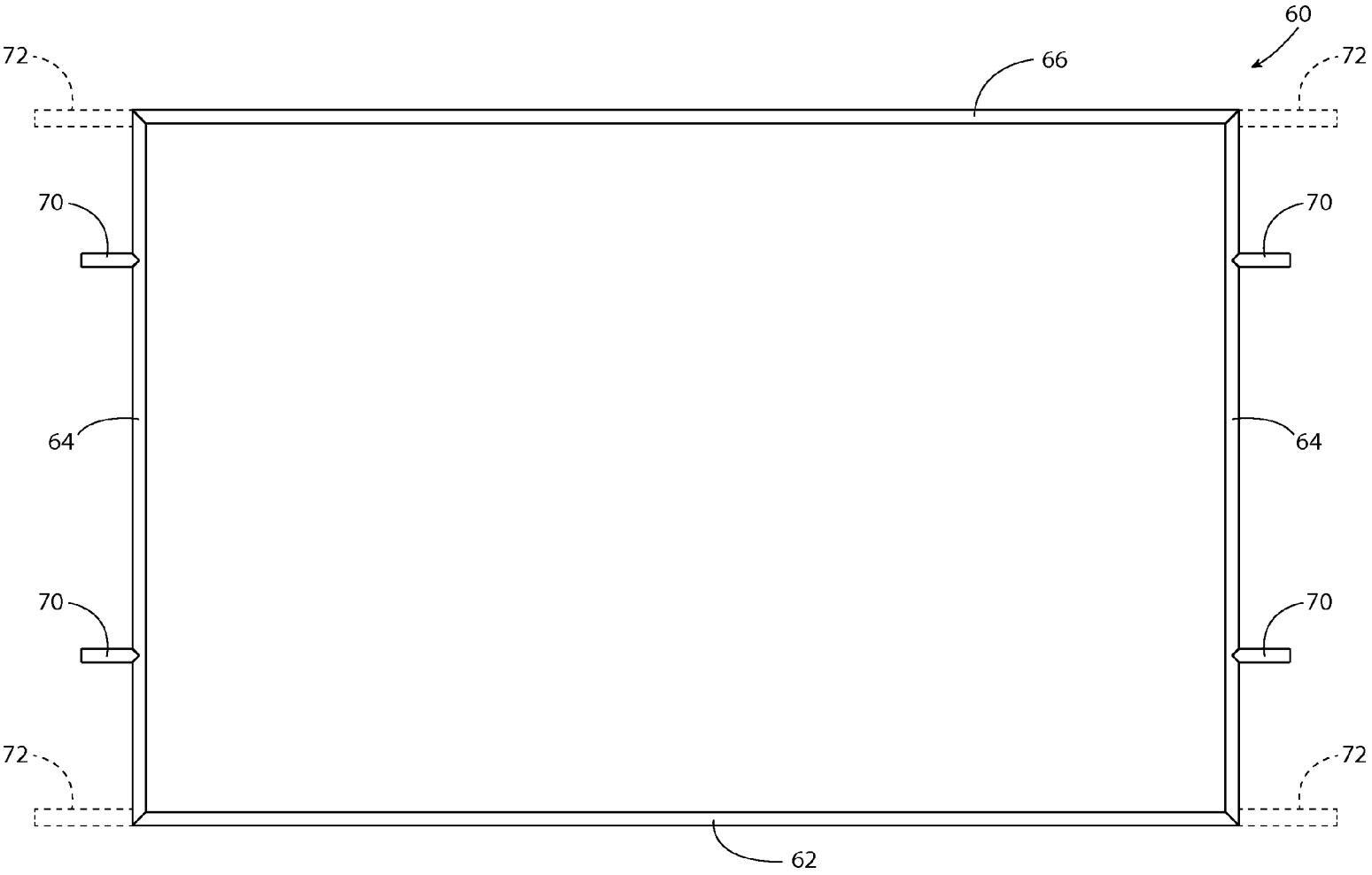
FIG. 4 is a top view of the reinforcing support frame of FIG. 3B.
Figure 5:
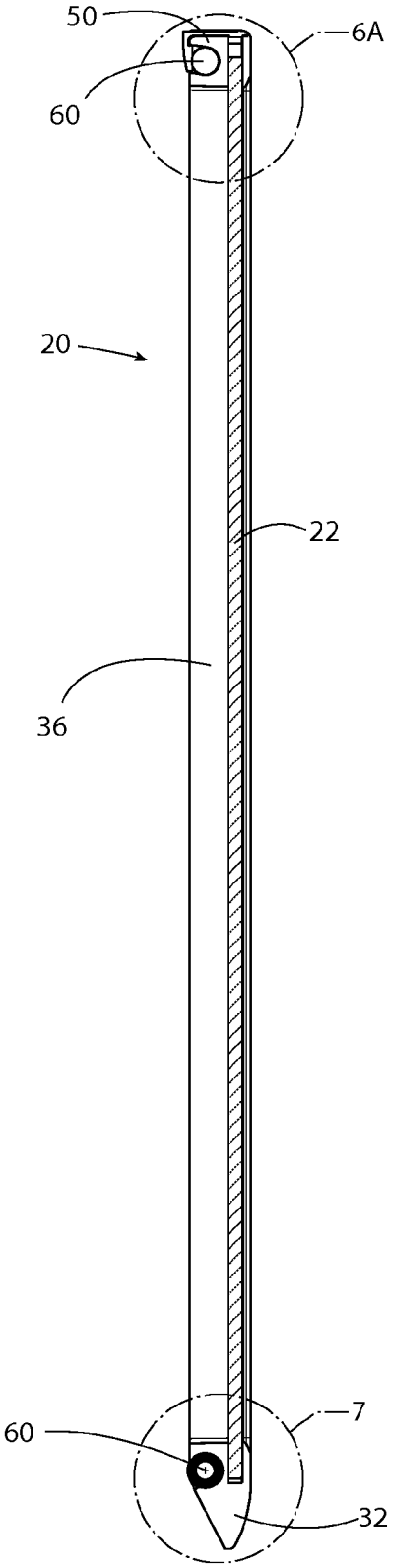
FIG. 5 is a sectional view taken along line 5-5 of FIG. 3B.

Turning now to FIGS. 3B-4, the shelf assembly can further include a reinforcing support frame 60 adapted to support the shelf frame 30 within said appliance. As noted above, the reinforcing support frame 60 can be used to increase the loading capacity of the shelf assembly 20, and can further be used to physically support the shelf assembly 20 within the interior of the appliance at a desired height and/or position. The reinforcing support frame 60 includes a front support member 62 at one end, and a rear support member 66 at the other end. Preferably, the reinforcing support frame 60 includes all of the front support member 62, the rear support member 66, and also opposed side support members 64.

The support frame 60 can be integrally formed as a monolithic body, or can be assembled together as a unitary body from separate elements. In one example, the support frame 60 can be produced from metal wire that has been worked into a shape corresponding to the outer periphery of the shelf frame 30. A single piece of wire can be formed into the desired shape and secured to itself, such as by welding, fasteners, or the like. Alternatively, two or more pieces of wire can be secured together. In one example, all of the front support member 62, opposed side support members 64, and rear support member 64 can be provided as separate elements that are welded together. Still, it is contemplated that the support frame 60 could be formed of other materials aside from metal wire, and/or could be cast or otherwise formed as a single, monolithic body, such as from a single piece of metal or the like. In yet another configuration, the support frame 60 could be provided as two or more independent support frames that are each secured to the shelf frame 30 to provide effective support across the entire shelf frame 30. For example, although not shown, a rear support frame could extend across the rear and partially along the sides of the shelf frame 30 (e.g., a "U"-shape), while a front support frame could similarly extend across the front and also partially along the sides of the shelf frame 30 (e.g., also a "U"-shape). The side portions of the independent shelf frames could include support studs or the like for supporting the shelf assembly within the refrigerator. This configuration could provide a benefit where each of the independent support frames could be formed separately from a single piece of wire, without the need to weld or otherwise secure parts together.

Preferably, the reinforcing support frame 60 is co-extensive with the with the support channel 40 of the shelf frame 30, and is captured within the support channel 40 to form a unitary shelf assembly 20. Further, the reinforcing support frame 60 is preferably co-extensive with outer periphery of the shelf frame 30 to thereby provide a strength support structure across the entire shelf assembly 20. In this manner, the reinforcing support frame 60 can provide suitable structural support to the shelf frame 30 despite often uneven loading of foodstuffs along the support surface 24 of the shelf panel 22. The support frame 60 it can have various geometries as might be desired for various shelf frames 30. For example, the reinforcing support frame 60 can be provided with a constant cross-sectional size and shape. Similarly, the support frame 60 may extends along a single plane, or it may extend along multiple planes.

The reinforcing support frame 60 further includes at least one stud 70 projecting laterally outward therefrom. In one example, the support frame 60 includes at least one stud 70 projecting outward from each of the opposed side support members 64. The studs 70 can be formed together with the side support members 64 as a monolithic body, or could be provided as separate elements that are removably or non-removably secured to form a unitary body. Preferably, the studs 70 are provided as metal wire that are welded or otherwise secured to each side support member 64. The studs 70 can be of a similar size, shape, and geometry as the side support members 64, or can be relatively larger, smaller, different shape, etc. as desired. Each stud 70 can project outward from a corresponding side support member 64 along a direction perpendicular to a longitudinal axis of said side support member 64. In other words, each stud 70 can project outwards perpendicular to the horizontal plane of the shelf panel 22. Still, any or all of the studs 70 could project outwards at other angles. Additionally, various numbers of studs 70 can be used. At a minimum, at least one stud 70 is provided to each side support member 64 so that the shelf assembly 20 is supported on each side. However, it can be beneficial to increase the number of studs 70. For example, the reinforcing support frame 60 can include a pair of studs 70 projecting outward from each of the opposed side support members 64 (i.e., two studs per side). The pair of studs 70 are preferably separate and spaced a distance apart from each other along the length of the associated side support member 64.

In the example shown in FIG. 4, the separate studs 70 are each spaced a distance from both of the front support member 62 and the rear support member 66. However, it is contemplated that a stud 72 could be secured to and/or projecting outwards from either or both of the front or rear support members 62, 66. As shown in phantom in FIG. 4, a stud 72 could be secured to or even formed as a part of the front or rear support members 62, 66. For example, either or both of the front or rear support members 62, 66 could be lengthened to extend a distance beyond the attachment point of the side support members 64 to effectively provide the studs 72 for attachment to the appliance liner interior. Further, the reinforcing support frame 60 could utilize a combination of the studs 70 on the side support members 64 and the studs 72 on either or both of the front or rear support members 62, 66. Alternatively, it is contemplated that the support frame 60 could comprise only a front support member 62 and a rear support member 66, without any intervening side support members. In this case, the studs 72 could project outwards from the sides of the shelf frame 30 as extensions of the front and rear support members 62, 66. Indeed, the front or rear support members 62, 66 could each comprise a straight wire that extends through the frame with the studs 72 extending a distance outwards to connect to the interior liner of the refrigerator.

The studs 70 are adapted to be received within a corresponding recess of an interior wall 210, 211 of the appliance to thereby support the shelf assembly 20 within said appliance. In other words, each studs 70 is removably inserted into a corresponding recess of the appliance interior liner, and support the entire shelf assembly 20 at a desired height and position within the refrigerator. The recesses of the appliance interior liner can be discrete, and/or may include a track so that the shelf assembly 20 can be slidably moved within the appliance interior. Thus, the studs 70 and their attachment to the side support members 64 should be of sufficient strength (i.e., shear strength) to support the entire expected loading of the shelf assembly, including the expected weight of the foodstuffs supported thereon. Even so, although not shown, it is contemplated that the refrigerator interior could also be provided with shelf supports formed into the liner that could provide some additional loading support for the shelf assembly 20. Finally, although also not shown, it is further contemplated that either or both of the front and rear support members 62, 66 could include a stud extending outward therefrom to provide additional mounting options for the shelf assembly 20 within the appliance.

Turning back to FIG. 3B, the reinforcing support frame 60 is shown assembled with the shelf frame 30 and shelf panel 22 to form the unitary shelf assembly 20. As can be seen, the reinforcing support frame 60 is received within the support channel 40 and is generally co-extensive with the outer periphery of the shelf frame 30: the front support member 62 is received within the front portion 42 of the support channel 40; the opposed side support members 64 are received within the side portions 44 of the support channel 40; and the rear support member 66 is received within the rear portion 46 of the support channel 40. Additionally, the studs 70 are received within the side apertures 48 of the shelf frame 30. As can be understood, the side apertures 48 are located at positions corresponding to the studs 70 to thereby permit the studs 70 to extend a distance outwards of the shelf frame 30. In this manner, the projecting portion of the studs 70 can thereby interface with the corresponding recesses of the sidewalls of the appliance interior liner.

Turning now to FIGS. 5-9, the interface between the support channel 40 and the reinforcing support frame 60 will be discussed. The reinforcing support frame 60 can be removably or non-removably coupled to the shelf frame 30. In one example, some or all of the reinforcing support frame 60 could be co-molded into the shelf frame 30, thus forming a monolithic body. In another example, as shown, the reinforcing support frame 60 can be removably coupled to the shelf frame 30 in a snap-fit manner. Still, other removable or non-removable assembly methods could be used, such as mechanical fasteners, adhesives, etc.

Figure 6A:
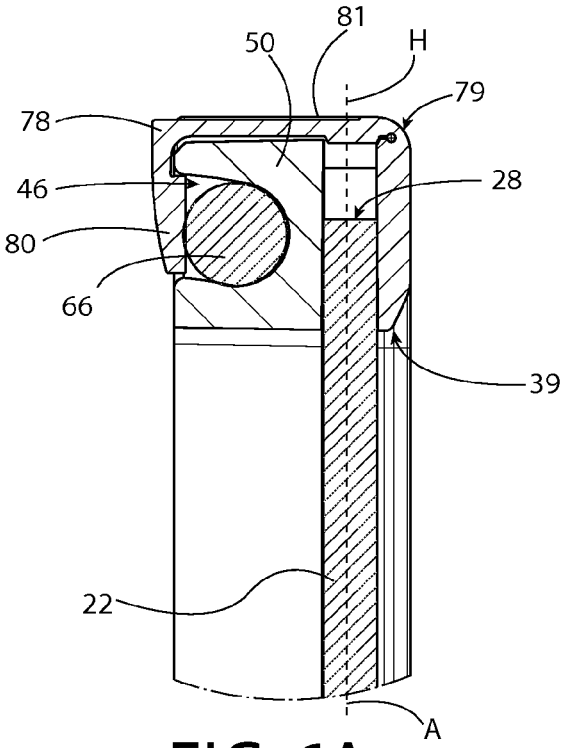
FIG. 6A is a detail view of FIG. 5 illustrating one embodiment of a rear portion of an example support channel.
Figure 7:
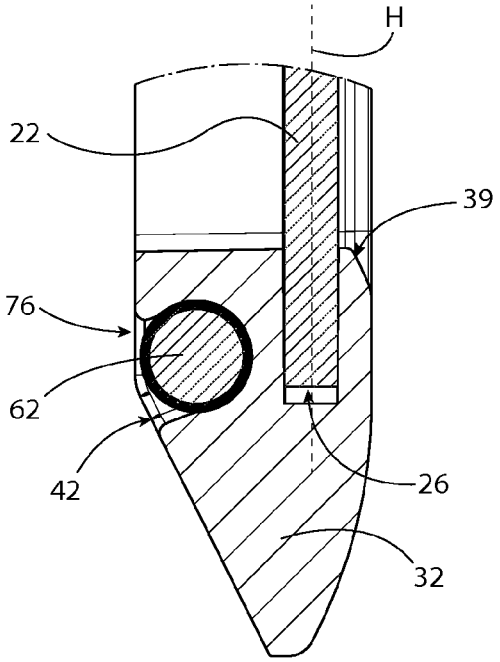
FIG. 7 is a detail view of FIG. 5 illustrating one embodiment of a front portion of an example support channel.

As shown in FIGS. 6A and 7, the front and rear portions 42, 46 of the support channel 40 can receive the reinforcing support frame 60 in a loose or tight-fit configuration. For example, the front portion 42 of the support channel 40 could have an opening 76 with a cross-sectional area (or width) less than the cross-sectional area (or width) of the front support member 62. However, the majority of the front portion 42 of the support channel 40 can have a cross-sectional area (or width) that is the same or larger than the cross-sectional area (or width) of the front support member 62. In this case, the front support member 62 can be forcibly inserted past the opening 76 and into the front portion 42 of the support channel 40 to be resiliently captured in a snap-fit manner. Alternatively, the front portion 42 of the support channel 40 could have a cross-sectional area (or width) less than the cross-sectional area (or width) of the front support member 62, so that the front support member 62 is secured via an interference fit.

Figure 9:
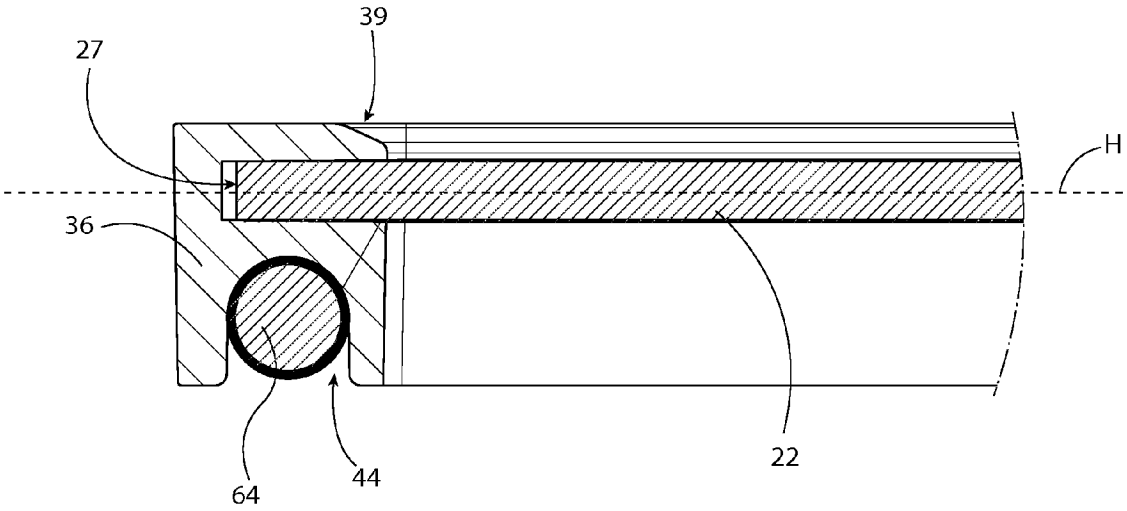
FIG. 9 is a detail view of FIG. 5 illustrating one embodiment of a side portion of an example support channel.

A similar arrangement could be provided for the rear portion 46 of the support channel 40. In that case, the rear support member 66 of the reinforcing support frame 60 can be resiliently captured within the rear portion 46 of the support channel 40 by a snap-fit connection (or even an interference fit). In yet another alternative, the support frame 60 may only be received via a snap-fit connection into one of the front or rear portions of the support channel 40, with a loose connection in the other. For example, as shown, only the front support member 62 of the reinforcing support frame 60 is resiliently captured within the front portion 42 of the support channel 40 by a snap-fit connection, while the rear support member 66 of the reinforcing support frame 60 is loosely contained within the rear portion 46 of the support channel 40. Similarly, as shown in FIG. 9, the side support members 64 can also be loosely contained within the side portions 44 of the support channel 40 (although they could also be retained by a snap-fit, interference fit, or other mechanical connection.

It is noted that the various portions of the support channel 40 can have various geometries to accommodate the desired fit or loose connection of the reinforcing support frame 60. Preferably, the overall geometry of the support channel 40 is similar to that of the reinforcing support frame 60. For example, where round metal wire is used to make the reinforcing support frame 60, the interior geometry of the support channel 40 can have a generally "C"-shaped geometry that is open towards an underside of the frame 30. Such a configuration enables the reinforcing support frame 60 to be assembled into the support channel 40 from below the frame. In one example assembly, first the front support member 62 can be snap-fit into the front portion 42 of the support channel 40, and then the remainder of the reinforcing support frame 60 can be pivoted upwards until the side support members 64 are contained within the side portions 44 and the rear support member 66 is also contained within the rear portion 46.

In order to retain the reinforcing support frame 60 in place, any or all of the side and rear support members 64, 66 are then further secured to the shelf frame 30. This can be accomplished by additional snap-fit or interference fit of the side and/or rear support members 64, 66. In one alternative embodiment, as shown in FIG. 6A, a rear hinge 78 or flap could be provided along some or all of the rear member 50 of the shelf frame 30 to retain the rear support member 66 within the rear portion 46 of the support channel. The rear hinge 78 could be pivotally connected to the rear member 50 in various manners, such as by a living hinge 79 (as shown) that is formed together with the shelf frame 30, by an attached pintle hinge, or by other types of hinges. The hinge 78 includes a bottom wall 80 that is arranged (in the closed position) to cover the opening of the rear portion 46 of the support channel to thereby prevent the rear support member 66 from being removed. In this manner, the reinforcing support frame 60 is secured to the shelf frame 30.

In an alternative embodiment, part of the support channel 40 may be partially closed to the underside shelf frame 30 to thereby support the reinforcing support frame 60. For example, the front portion 42 of the support channel 40 could comprise an "L"-shaped geometry, when viewed from the side, that includes a bottom opening adjacent to an interior shelf. In this case, the front support member 62 can be received within the bottom opening of the "L"-shaped geometry of the front portion 42, and then shifted upwards and laterally forward or rearward to rest upon the adjacent interior shelf against the force of gravity. Thereafter, the side and/or rear support members 64, 66 could be secured to the rear or side portions of the support channel 40 via a snap-fit or other mechanism. Preferably, the distance between the interior shelf of the "L"-shaped geometry of the front portion 42 and center of the rear portion 46 is approximately equal to the distance between the front and rear support members 62, 66 so that the reinforcing support frame 60 has a tight fit onto the shelf frame 30. Other arrangements of the support channel 40 including a shelf are contemplated. For example, the rear portion 46 of the support channel 40 could have a "C"-shaped geometry that is open towards a rear of the shelf frame 30 to thereby provide an adjacent interior shelf for the rear support member 66 to rest upon against the force of gravity. The front portion 42 of the support channel 40 could have a "C"-shaped geometry that is open towards the bottom of the shelf frame 30, similar to that shown in FIG. 7. Once the rear support member 66 is received upon the interior shelf of the rear portion 46, the front support member 62 can be secured to the front portion 42 of the support channel 40 via a snap-fit or other mechanism. Various other configurations of the above examples are contemplated, including a rearrangement of the front, rear, or side portions of the support channel and support frame.

Finally, the shelf frame 30 of the instant application is designed to removably retain the glass panel in a slide-in manner. The shelf frame includes an internal glass support channel that supports the glass panel around at least three, and preferably all four, sides of its outer perimeter. A front glass support channel can extend at least partially, and preferably substantially completely, along the front member 32 of the frame. Similarly, side glass support channels can extend, at least partially, and preferably substantially completely, along the opposed side members 36 of the shelf frame. Any or all of the front and side glass support channels can be continuous or discontinuous, and may further include stops or other alignment projections therein to guide or align the shelf panel. Further, the support channel 40 for the reinforcing support frame can have various geometries and can be arranged variously, although it is preferred that the support channel 40 is substantially parallel with the horizontal plane H of the support surface 24 of the shelf panel 22. In this manner, the opposed side support members 64 of the reinforcing support frame 40 can at least partially define the side glass support channels of the shelf frame 30 that receive and support the glass shelf panel 22 against the force of gravity. Indeed, it is contemplated that the shelf frame 30 may not include any side glass support channels, but may instead rely upon the opposed side support members 64 of the reinforcing support frame 40 to support the glass shelf panel 22.

In the assembled state of the shelf assembly 20, suitable for supporting food or the like within the refrigerator, the rear support channel for the glass panel is aligned to be substantially co-planar with the horizontal plane H. In one example, all of the front glass support channel, side glass support channels, and rear glass support channel form the internal glass support channel and are substantially co-planar with the horizontal plane H so that the shelf panel 22, when fully inserted into the frame 30, will be maintained in a flat and level arrangement along the direction of the horizontal plane H to support items within the refrigerator. In summary, the internal glass support channel, including the front, side and rear support channels, can facilitate retention of the shelf panel 22 on the frame 30 without the use of an adhesive, mechanical fasteners, or the like. In other words, when the rear edge 28 of the shelf panel 22 is received and captured within the rear glass support channel, the shelf panel 22 cannot be removed from the frame 30 along the direction of the horizontal plane H without further manipulation of the shelf frame 30.

Turning first to FIG. 6A, a first embodiment of the rear glass support channel for the glass shelf panel 22 can be provided by the rear member 50 and located above the rear portion 46 of the support channel 40. The glass shelf panel 22 can be retained within the rear glass support channel by the hinge 78. For example, when the hinge 78 is in a closed position, a vertical wall 81 can cover the rear glass support channel to thereby prevent the glass shelf panel 22 from being removed from the shelf frame 30. Pivotally opening the hinge 78 can then move the vertical wall 81 outwards to thereby uncover the rear glass support channel to permit insertion or removal of the glass shelf panel 22. The vertical wall 81 could further include an alignment projection or stop that extends into the rear glass support channel to abut the rear edge 28 of the glass shelf panel 22.

Figure 6B:
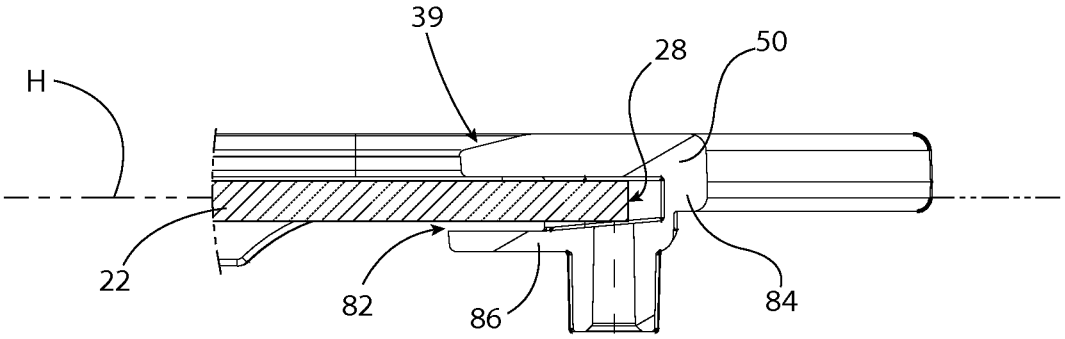
FIGS. 6B-6C are similar to FIG. 6A, but show another example embodiment.
Figure 6C:
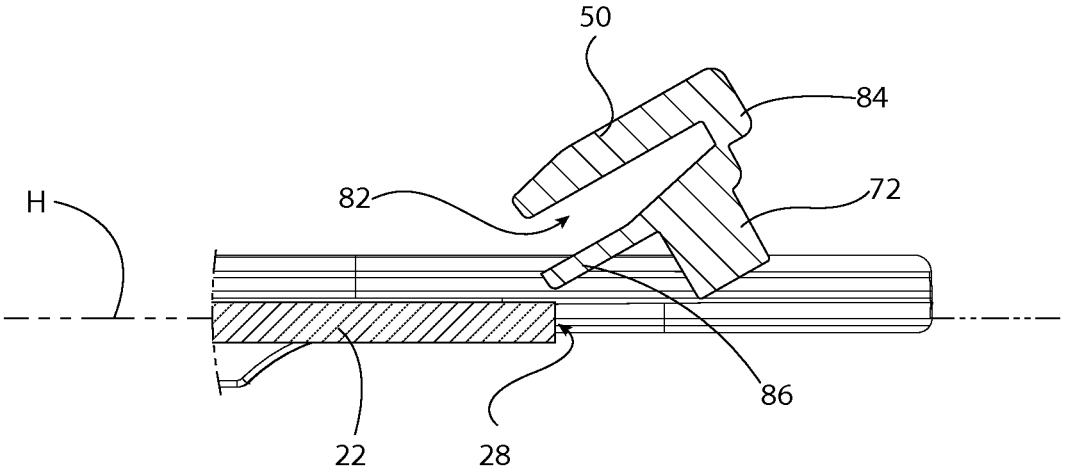
Figure 8:
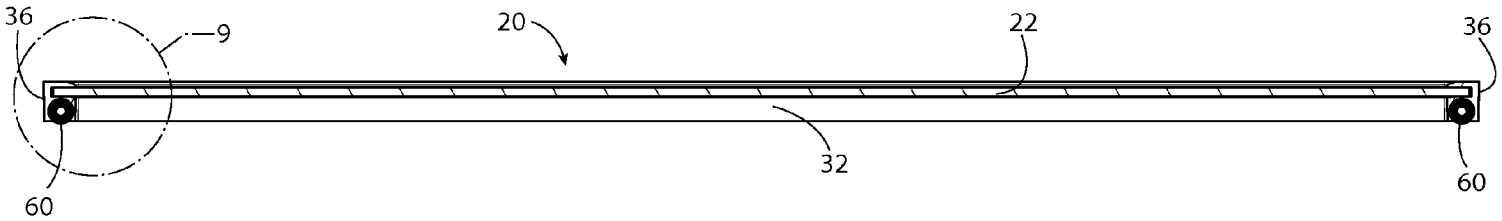
FIG. 8 is a sectional view taken along line 8-8 of FIG. 3B.

In an alternative embodiment, turning briefly to FIGS. 6B-6C, the frame 30 could include a rear support channel 82 formed with and extending below the rear member 50. The rear support channel 82 is adapted to removably receive and capture the rear edge 28 of the shelf panel 22 to support the shelf panel 22 against the force of gravity and to thereby inhibit removal of the shelf panel 22 from the frame in the direction of the horizontal plane H. The rear support channel 82 extends at least partially along the length of the rear member 50. As shown, the rear support channel 82 extends along less than an entire length of the rear member 50, such as about 90% or less, about 80% or less, about 70% or less, about 60% or less, or about 50% or less, about 40% or less, about 30% or less, or even about 20% or less. Preferably, the rear support channel 82 extends along less than about 50% of the entire length of the rear member 50. More preferably, the rear support channel 82 is positioned at the approximate center of the rear member 50. Still, in other examples, the rear support channel 82 could extend along substantially the entire length of the rear member 50, or could even comprise a plurality of discontinuous support channels (not shown).

The rear support channel 82 includes a first wall 84 extending downwards from the rear member 50 along a direction substantially perpendicular to the horizontal plane H (i.e., a vertical wall), and the second wall 86 projecting outwards from the first wall 54 along a direction substantially parallel to the horizontal plane H (i.e., a horizontal wall). Both of the first and second walls 84, 86 may be integrally formed together with the frame 30 or may be provided as a separate elements. Thus, the rear support channel 82 is defined between at least an underside of the rear member 50 and the second wall 86, and may be further defined by the first wall 84. A distance between the underside of the rear member 50 and the second wall 86 is substantially equal to a thickness of the rear edge 28 of the shelf panel 22 to thereby provide a relatively tight fit within the rear support channel 82. As a result, the rear support channel 82 comprises a cross-sectional area substantially corresponding to the rear edge 28 of the shelf panel 22. The combination of the underside of the rear member 50, the first wall 84 and the second wall 86 can define a "C"-shaped channel. Thus, when the shelf panel 22 is received within the rear support channel 82, the vertical first wall 84 inhibits removal of the shelf panel 22 from the frame in the direction of the horizontal plane H, and the horizontal second wall 86 supports the shelf panel 22 against the force of gravity. Thus, when the support surface 24 is loaded via food or the like, the first and second walls 84, 86 of the rear support channel 82 to inhibit the shelf panel 22 from falling or tilting due to the loading.

The shelf panel 22 is selectively insertable or removable from the rear support channel 82 by temporarily deflecting the rear support channel 82 upwards relative to the horizontal plane H a sufficient amount to separate the rear edge 28 of the shelf panel 22 from the rear support channel 82. The deflection is used because the rear support channel 82 is aligned to be substantially co-planar with the horizontal plane H, and thus the rear support channel 82 is first displaced out of the way prior to receiving or releasing the rear edge 28 of the shelf panel. In one example, the shelf panel is selectively insertable or removable from the rear support channel 82 by temporarily deflecting the rear member 50 upwards relative to the horizontal plane H a sufficient amount to separate the rear edge 28 of the shelf panel 22 from the rear support channel 82. That is, the rear support channel 82 can be temporarily deflected upwards, in an elastic manner, so that the rear support channel 82 is moved out of the horizontal plane H, and is temporarily positioned above the horizontal plane.

Thereafter, the rear member 50 can be manipulated into place so as to capture and retain the rear edge 28 of the shelf panel 22 within the rear support channel 82. In another example, the shelf panel 22 is selectively insertable or removable from the rear support channel 82 by temporarily translating the rear member 50 upwards a distance (i.e., above the horizontal plane H) while simultaneously rotating the rear member 50 to an angle relative to the horizontal plane H. The act of rotating the rear member 50 further moves the rear support channel 82 outwards away from the rear edge 28 of the shelf panel 22 to thereby permit the rear support channel 82 to be manipulated into a position to receive and retain the rear edge 28 of the shelf panel 22. Moreover, the act of rotating the rear member 50 outwards to an angle relative to the horizontal plane will separate and release the horizontal second wall 56 of the rear support channel 82 from underneath the rear edge 28 of the shelf panel 22, which then permits the rear member 50 to translate further upwards. In order to facilitate the assembly or disassembly of the shelf panel 22, only a portion of the rear member 50 containing the rear support channel 82 is typically deflected upwards to selectively insert or remove the shelf panel 22 from the frame 30.

Disassembly of the shelf panel 22 from the frame 30 occurs in reverse. First the portion of the rear member 50 containing the rear support channel 82 is translated upwards while being simultaneously rotated outwards to release the rear edge 28. Thereafter, the shelf panel 22 is pulled backwards to be removed from the front support channel and is slid along the side support channels. The shelf panel 22 continues to be slidably removed from the frame until it is completely free of the side support channels 38 and separated from the frame. The rear member 50 is released and then it elastically and resiliently returns to its nominal position with the rear support channel 82 in alignment with the horizontal plane H.

In addition or alternatively, the frame 30 can further include lower support channels (not shown) for supporting drawers or other depending structure. For example, the frame 30 could include two pairs of lower support channels to for two or more independent deli drawers in a side-by-side arrangement. In an alternative arrangement, a single center lower support channel could provide a double support for each of the two side-by-side drawers. In one example, the lower support channels could be designed as a sliding support track with a built-in roller wheel and a drawer anti-removal stops at the front end of the support track. The built-in roller wheels rotate against a corresponding track molded into the deli drawer. Similarly, the sliding deli drawer includes a pair of roller wheels at a rear end of the drawer that roll along the sliding support track of the support channels. Thus, the deli drawer is supported by four total roller wheels. Each of the lower support channels can be snap-fit into a slot at the front edge of the frame. Each of the lower support channels is further supported by either a snap-fit connection at the rear member 50 of the frame 30, or via a mechanical faster that is secured into a boss at the rear member 50 of the frame 30. However, it is contemplated that some or all of the lower support channels could also be integrally molded to the underside of the shelf frame.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A shelf assembly for an appliance, comprising:

a shelf panel comprising a generally planar support surface;

a shelf frame adapted to be mounted within an appliance to support the shelf panel with the support surface extending generally along a horizontal plane, the shelf frame comprising a front member with a front support recess, opposed side members each with a side support recess, and a rear member that together define an outer periphery, wherein the front support recess is sized to slidingly receive and support the front edge of the shelf panel and the side support recesses are each sized to slidingly receive and support one of the opposed side edges of the shelf panel against the force of gravity;

a support channel formed into an underside of the outer periphery of the shelf frame along each of the front member, opposed side members, and the rear member so that the support channel is substantially co-extensive with the outer periphery;

a reinforcing support frame adapted to support the shelf frame within said appliance, the reinforcing support frame comprising a front support member, opposed side support members, and a rear support member, wherein the reinforcing support frame is co-extensive with the support channel of the shelf frame and is captured within the support channel to form a unitary shelf assembly, and wherein the front support member of the reinforcing support frame is resiliently captured within a front portion of the support channel by a snap-fit connection; and at least one stud projecting outward from each of the opposed side support members of the reinforcing support frame, wherein the studs are adapted to be received within a corresponding recess of an interior wall of said appliance to thereby support the shelf assembly within said appliance.

2. The shelf assembly of claim 1, wherein each stud projects outward from a corresponding side support member along a direction perpendicular to a longitudinal axis of said side support member.

3. The shelf assembly of claim 1, wherein each opposed side member of the shelf frame comprises a side aperture located at a position corresponding one of the studs, the side aperture extending from the support channel and to an exterior of the shelf frame.

4. The shelf assembly of claim 1, wherein said at least one stud comprises a pair of studs projecting outward from each of the opposed side support members, the pair of studs being separate and spaced a distance apart from each other.

5. The shelf assembly of claim 1, wherein each stud is spaced a distance from both of the front support member and the rear support member.

6. The shelf assembly of claim 1, wherein the support channel is integrally formed into the outer periphery as a monolithic element with the shelf frame.

7. The shelf assembly of claim 1, wherein the rear support member of the reinforcing support frame is resiliently captured within a rear portion of the support channel by a snap-fit connection.

8. The shelf assembly of claim 1, wherein the support channel is substantially parallel with the horizontal plane.

9. The shelf assembly of claim 1, further comprising a rear support channel formed with and extending below the rear member of the shelf frame, the rear support channel adapted to removably receive and capture a rear edge of the shelf panel to support the shelf panel against the force of gravity and to thereby inhibit removal of the shelf panel from the shelf frame.

10. The shelf assembly of claim 9, wherein the shelf panel is selectively insertable or removable from the rear support channel by temporarily deflecting the rear support channel upwards relative to the horizontal plane a sufficient amount to separate the rear edge of the shelf panel from the rear support channel.

11. A shelf assembly for an appliance, comprising:

a shelf panel comprising a generally planar support surface;

a shelf frame adapted to support the shelf panel with the support surface extending generally along a horizontal plane, the shelf frame comprising a front member with a front support recess, opposed side members each with a side support recess, and a rear member that together define an outer periphery, wherein the shelf frame comprises a central opening extending through the shelf frame and bounded by the outer periphery, the central opening occupying a majority of the shelf frame and which is covered by the shelf panel, and wherein the front support recess is sized to slidingly receive and support the front edge of the shelf panel and the side support recesses are each sized to slidingly receive and support one of the opposed side edges of the shelf panel to thereby cover the central opening;

a support channel integrally formed as a monolithic element with the shelf frame into an underside of the shelf frame along each of the front member and the rear member so that the support channel is substantially co-extensive with the front and rear members;

a reinforcing support frame adapted to support the shelf frame within said appliance, the reinforcing support frame comprising a front support member and a rear support member, wherein the reinforcing support frame is co-extensive with the support channel of the shelf frame along the front and rear members and is captured within the support channel to form a unitary shelf assembly; and at least one stud projecting outward from the reinforcing support frame with respect to each of the opposed side members of the shelf frame and along a direction perpendicular to a longitudinal axis of said opposed side members, wherein the studs are adapted to be received within a corresponding recess of an interior wall of said appliance to thereby support the shelf assembly within said appliance.

12. The shelf assembly of claim 11, wherein the studs are formed with and projects outwards from one of the front or rear support members of the reinforcing support frame.

13. The shelf assembly of claim 11, wherein the reinforcing support frame further comprises opposed side support members, and wherein each stud projects outward from a corresponding side support member along a direction perpendicular to a longitudinal axis of said side support member.

14. The shelf assembly of claim 13, wherein each opposed side member of the shelf frame comprises a side aperture located at a position corresponding one of the studs, the side aperture extending from the support channel and to an exterior of the shelf frame.

15. The shelf assembly of claim 13, wherein said at least one stud comprises a pair of studs projecting outward from each of the opposed side support members, the pair of studs being separate and spaced a distance apart from each other.

16. The shelf assembly of claim 13, wherein each stud is spaced a distance from both of the front support member and the rear support member.

17. The shelf assembly of claim 11, wherein one of the front support member and rear support member of the reinforcing support frame is resiliently captured within a corresponding one of a front portion of the support channel and a rear portion of the support channel by a snap-fit connection.

18. The shelf assembly of claim 11, further comprising a rear support channel formed with and extending below the rear member of the shelf frame, the rear support channel adapted to removably receive and capture a rear edge of the shelf panel to support the shelf panel against the force of gravity and to thereby inhibit removal of the shelf panel from the shelf frame, wherein the shelf panel is selectively insertable or removable from the rear support channel by temporarily deflecting the rear support channel upwards relative to the horizontal plane a sufficient amount to separate the rear edge of the shelf panel from the rear support channel.

19. The shelf assembly of claim 1, wherein the rear member of the shelf frame comprises a hinge with a bottom wall, and wherein the rear support member of the reinforcing support frame is captured within a rear portion of the support channel by the bottom wall of the hinge when the hinge is in a closed condition.

20. The shelf assembly of claim 19, wherein the hinge is pivotally connected to the rear member by a living hinge.

* * * * *